US005524657A

United States Patent [19]

Jih

[11] Patent Number: 5,524,657

[45] Date of Patent: Jun. 11, 1996

[54] UNIVERSAL ATTACHMENT FOR WALKING ASSISTIVE DEVICES

[76] Inventor: Pey-en Jih, 2505 Vine Hill Rd., Scotts Valley, Calif. 95066

[21] Appl. No.: 491,235

[22] Filed: Jun. 16, 1995

Related U.S. Application Data

[63] Continuation of Ser. No. 309,094, Sep. 20, 1994, abandoned.

[51] Int. Cl.[6] ..... A45B 3/00

[52] U.S. Cl. ..... 135/66; 135/67

[58] Field of Search ..... 135/65–67

[56] References Cited

U.S. PATENT DOCUMENTS

| | | | |
|---|---|---|---|
| 2,708,473 | 5/1955 | Gable et al. | 135/67 |
| 2,796,916 | 6/1957 | Womble | 135/67 |
| 3,443,569 | 5/1969 | Ernst | 135/66 |
| 3,999,565 | 12/1976 | Delacour et al. | 135/65 |
| 4,141,375 | 2/1979 | Tykwinski | 135/66 |
| 4,248,256 | 2/1981 | Thomas | 135/67 |
| 4,722,356 | 2/1988 | Rehder | 135/67 |
| 5,086,798 | 2/1992 | Motts . | |
| 5,291,909 | 3/1994 | Skorman et al. | 135/67 |

*Primary Examiner*—Lanna Mai
*Attorney, Agent, or Firm*—Samson G. Yu

[57] ABSTRACT

A knee/thigh pad holder assembly has adapter hardware for mounting adjustably to a wide variety of ambulatory aids such as walkers, canes, and crutches. The adapter hardware in one embodiment includes a bracket bolted to a knee/thigh pad holder with a holding rod clamped between the bracket and the knee/thigh pad holder. Adjustable clamps with clamping screws are employed to mount the knee/thigh pad holder via the holding rod across two parallel frame members of a walker. In another embodiment, a shorter tube is used in place of the holding rod, and rod clamps are pivotally attached to the short tube, such that the assembly may be adjustably mounted to a single upright member, providing thereby adjustable mounting to such as canes and crutches.

7 Claims, 4 Drawing Sheets

UNIVERSAL ATTACHMENT FOR WALKING ASSISTIVE DEVICES

This is a continuation of application Ser. No. 08/309,094 filed on Sep. 20, 1994, now abandoned.

BACKGROUND OF THE INVENTION

The present invention relates to ambulatory aids for disabled, post-operative or injured people who need additional support and stability in moving about or standing, more particular, to an universal attachment which can be detatchably secured on walking assistive devices. A major objective of the presentive invention is to provide support for weigh-bearing on limbs, aiding disabled, post-operative or injured people to be ambulant as in normal walking.

The present invention is in the area of apparatus for aiding injured or otherwise disabled persons to walk, and pertains in particular to knee/thigh pad apparatus for assembly to walkers, canes, and the like.

Each year, tens of thousands of people suffer from ankle, foot, or knee injuries which result in restricted weight-bearing. Additionally, many who have had ankle, foot, or knee surgery have restricted post-operative weight-bearing capabilities. Numerous walking aids exist to assist ambulation in those with weight-bearing restrictions or amputations of lower limbs. These walking aids typically require the user to support him- or herself by gripping handles (for example, quad canes, hemiwalkers, canes, walkers) or using upper-body strength (crutches) for support. Many people have insufficient upper body and arm strength to effectively manipulate these implements.

Knee/thigh support devices which attach to multi-legged walkers have been developed to provide a resting place for the injured leg. However, the existing devices are limited to walkers in their application, and none has been developed to adapt to other walking aids such as quad canes, canes, and crutches.

For example, Skorman, U.S. Pat. No. 5,291,909, discloses a vertically adjustable leg support device that mounts to an invalid walker with a number of legs. However, the Skorman device is incapable of attachment to a single-legged walking aid. Neither is it capable of being adjusted to provide thigh support.

Likewise, Motts, U.S. Pat. No. 5,086,798 discloses a leg support device that may be mounted either right or left on an invalid walker with a number of legs, yet the Motts device is also incapable of attachment to a single-legged walking aid or provide thigh support.

What is clearly needed is a versatile apparatus with a cushioned platform that is applied to walking assistive devices such as walkers, quad canes, canes, and crutches mentioned above.

SUMMARY OF THE INVENTION

In accordance with the present invention, an attachment for a walking assistive device comprises a cushioned platform and coupling means. The cushioned platform has a first portion on which a cushion is mounted and a second portion traversely extenting from the first portion. The platform is essentially appeared in either L or T shape. The coupling means is then detachably secured to the second portion for applying the attachment to a rod of the walking assistive device.

Furthermore, the coupling means includes bracket means being detachably secured to the second portion; holding means being secured between the bracket means and the second portion for allowing the cushioned platform to be adjusted along an axis of the holding means and fastening means being affixed on the holding means for detachably applying the holding means to a rod of the walking assistive device.

The bracket means and holding means can be integrated so that the height of the cushioned platform can be adjusted by changing the position of the holding means that is coupled to the pair of rods with the holding means. The bracket means and holding means are also angularly adjustable relative to the second portion of the cushioned platform. The adjustable angle is between angle can be 90°.

The holding means includes a rod having a first end and a second end. The rod has coupling means affixed on the rod for detachably securing the first end and the second end of the rod to a pair of holding rods of the walking assistive devices. The coupling means includes a pair of adjustable clamps for clamping the first end and the second end of the rod to a pair of holding rods.

The attachment in accordance with the present invention can be easily applied to walking assistive devices to provide knee-support, thigh-support, or arm support with the adjustment of the height of the attachment. Furthermore, the attchment in accordance with the present invention can be horizontally adjusted to allow the user to have an normal gait when walking.

BRIEDESCRIPTION OF THE DRAWINGS

DESCRIPTION OF THE PREFERRED EMBODIMENTS

Figure 1:
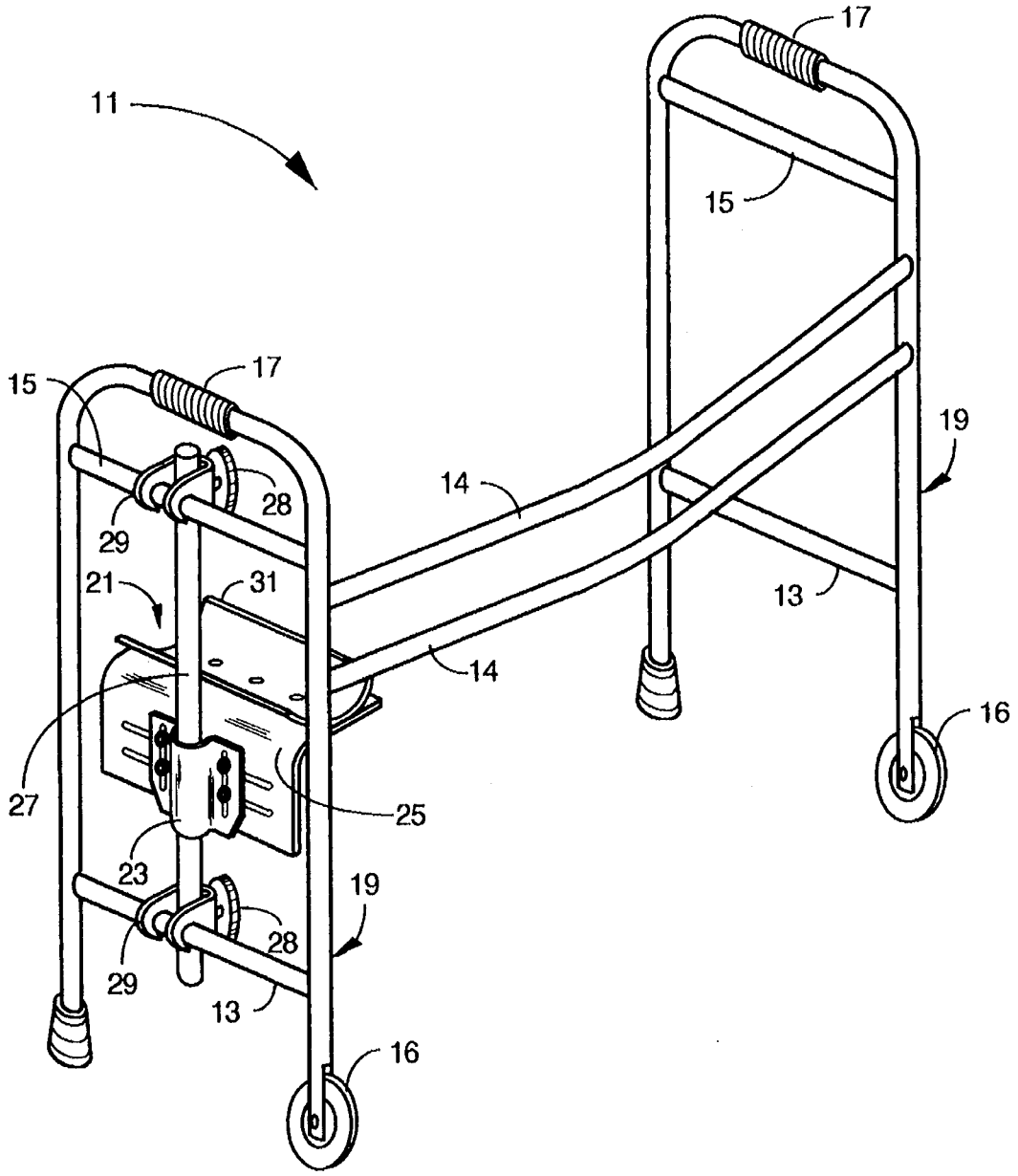
FIG. 1 is a perspective view of a knee/thigh platform device according to a preferred embodiment of the invention, mounted to a typical invalid walker.
Figure 2:
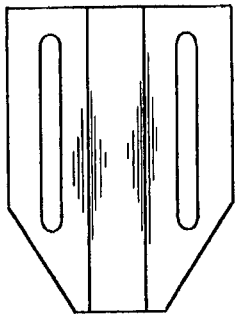
FIG. 2 is an illustration of an adjustable flange bracket, an element of the embodiment shown in FIG. 1.

FIG. 1 shows a typical invalid walker 11 to which knee/thigh platform device 21, according to a preferred embodiment of the present invention, is mounted. Invalid walker 11 includes upright frame structures 19 with hand grips 17, parallel right and left fore-to-aft upper braces 15, parallel right and left fore-to-aft lower braces 13, and cross-members 14. There are wheels 16 on this particular model to facilitate movement.

Knee/thigh platform device 21 includes knee/thigh pad holder platform 25, formed with two surfaces at a ninety degree angle, and having two parallel elongated slots running along the length of one side. Knee/thigh pad cushion 31 is mounted to platform 25 by conventional bolts and nuts. It will be apparent to those with skill in the mechanical arts that there are a number of other kinds of fasteners that can be used.

Platform 25 is mounted to walker 11, parallel to horizontal braces 13 and 15, by a simple assembly consisting of a holding rod 27, two adjustable clamps 29, and an adjustable flange bracket 23. In practice, flange bracket 23 and platform 25 are manufactured with rounded edges to prevent injury to a user.

Adjustable clamp 29 uses pressure from a clamp screw 28 with a tightening knob to attach to holding rod 27, preferably constructed of a light-weight, high strength metal, to upper fore-to-aft tubular brace 15 of walker 11. A second adjustable clamp 29, also having a clamp screw and knob 28, is used to attach holding rod 27 to the walker's lower fore-to-rear tubular brace 13. The contoured vertical section of adjustable flange bracket 23 mates with holding rod, 27 and mounts flush against knee/thigh pad holder platform 25 by being bolted through its four openings, arranged in a square pattern in this embodiment, and through the platform's four elongated slots.

The elongated slots in platform 25 permit horizontal adjustment to the position most comfortable for a particular user, and adjustable flange bracket 23 allows for vertical adjustment as well.

While FIG. I shows knee/thigh platform device 21 mounted on one side of walker 11, it will be appreciated that it can be readily mounted on the other side of walker 11 as well, if desired. Knee/thigh platform device 21 can be easily applied to walking assistive devices to provide knee-support, thigh-support, or arm support with the adjustment of its height along holding rod 27. Furthermore, knee/thigh platform device 21 can be horizontally adjusted by moving holding rod 27 along both lower fore-to-rear tubular brace 13 and upper fore-to-rear tubular brace 15 to allow the user to have an normal gait when walking. Also, knee/thigh platform device 21 can be adjusted around holding rod 27 to change the angle relative to the plane formed by fore-to-rear tubular braces 13 and 15.

By virtue of the square bolt pattern in adjustable bracket 23, the adjustable bracket may be rotated ninety degrees, wherein the holding rod 27 is also rotated ninety degrees, enabling mounting between vertical members of the walker shown, or other similar walkers, while still allowing for adjustment of the position of the knee/thigh pad holder. In addition, knee/thigh platform device 21 can be used as either knee platform or thigh plastform, depending on the level of knee/thigh pad cushion 31. For example, platform device 21 provides knee support usually, but it also provides thigh support if knee/thigh pad cushion 31 is simply adjusted to hip level along the holding rod 27. Therefore, platform device 21 is a flexible and easy-to-use attachment for walking assistive devices.

Figure 3:
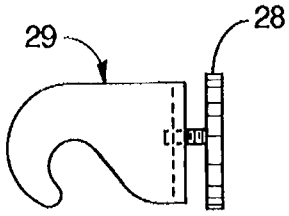
FIG. 3 is a side view of an adjustable clamp, an element of the embodiment shown in FIG. 1.
Figure 4:
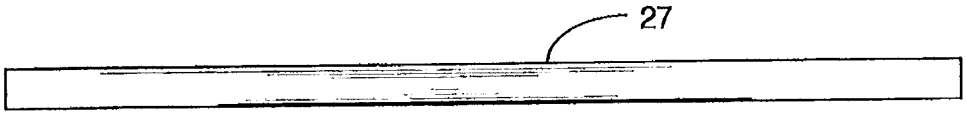
FIG. 4 is a side view of a holding rod, an element of the embodiment shown in FIG. 1.
Figure 5:
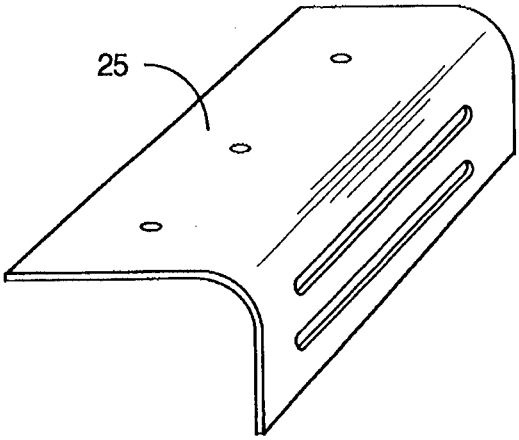
FIG. 5 is a perspective view of a pad holder platform, an element of the embodiment shown in FIG. 1.
Figure 6:
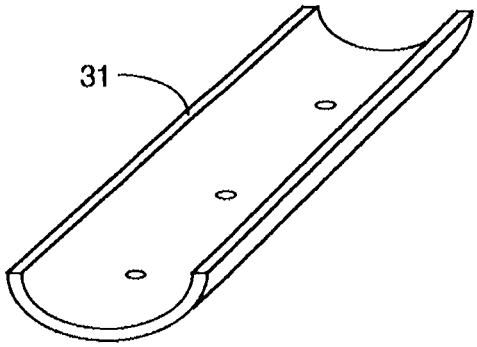
FIG. 6 is a perspective view of a pad, an element of the embodiment shown in FIG. 1.

FIGS. 2–6 illustrate the construction of individual elements of device 21 in the embodiment of FIG. 1. Clamp screw and knob 28 is shown in FIG. 3 as a part of adjustable clamp 29.

An important feature of the present invention, shown in an alternative embodiment described below, is that the knee/thigh pad holder may be mounted vertically to a number of walking aids, comprising, but not limited to, hemiwalkers, quad canes, canes, or crutches.

Figure 7:
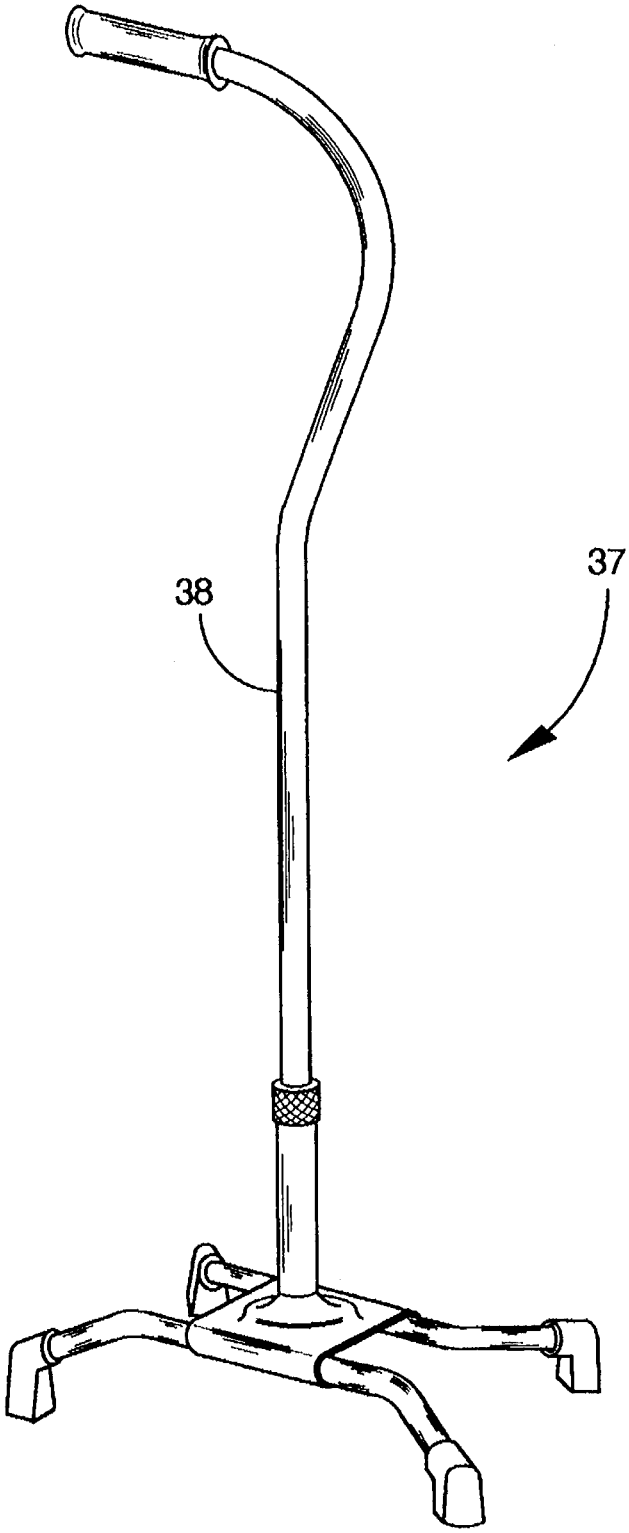
FIG. 7 is a perspective view of a typical quad cane walking aid.

FIG. 7 is a perspective view of an invalid quad cane 37 having a single vertical shaft 38 to which a knee/thigh platform device according to an alternative embodiment of the present invention may be mounted.

Figure 8:
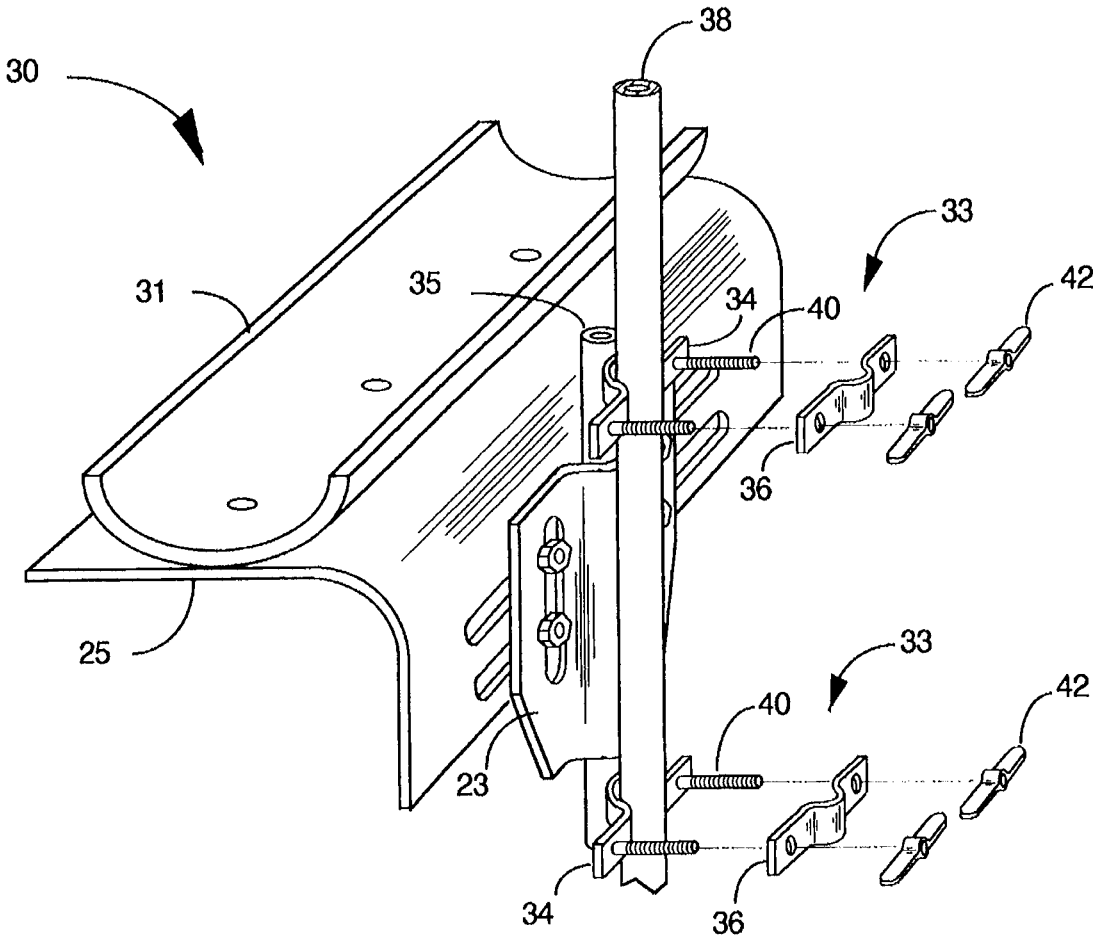
FIG. 8 is a perspective view of the knee/thigh platform device attached to a section of the quad cane walking aid of FIG. 7.

FIG. 8 is a perspective view of a portion of vertical shaft 38 of quad cane 37 illustrating mounting of a knee/thigh platform device 30 according to an alternative embodiment of the present invention. In this alternative embodiment, a short tube 35 is utilized in place of holding rod 27 shown in FIG. 1. In this alternative embodiment, knee/thigh platform device 30 is secured to the quad cane or other walking aid by means of two contoured clamps 33 which are pivotally attached to upper and lower portions of short tube 35. Each of the clamps comprises a base portion 34, a clamp portion 36, bolts 40, and wing nuts 42 for secure clamping to shaft 38.

Although not shown in FIG. 8, pads made of a flexible material such as rubber are placed under contoured clamps 33 around shaft 38 to protect the finish of the shaft and to facilitate secure clamping.

It will be appreciated that the invention in the alternative embodiment described with reference to FIG. 8 also permits vertical and horizontal adjustment of device 30 to accommodate different physical characteristics different users.

In still another alternative embodiment, a longer tube 35 is used, and one of contoured clamps 33 may be adjustable relative to the other along tube 35 to provide additional flexibility in mounting. In this embodiment, with clamps 33 being pivotally attached to tube 35, the knee/thigh pad assembly may be mounted to tubes or rails that are not parallel.

It will be appreciated that knee/thigh platform devices according to various embodiments of the present invention are adaptable to many walking aids. They offer suppliers of durable medical equipment, such as physicians, physical therapists, equipment rental businesses, and retailers, optional equipment that can be mounted to a wide variety of walking aids. They offer those whose condition restricts leg, foot, or ankle weight-bearing a support device which can be readily mounted to any number of walking aids.

It therefore will be readily understood by those persons skilled in the art that the present invention provides broad utility and application. Many embodiments and adaptations of the present invention other than those herein described, as well as many variations, modifications, and equivalent arrangements will be apparent from or reasonably suggested by the present invention and the foregoing description thereof, without departing from the spirit or scope of the present invention. Accordingly, while the present invention has been described herein in detail in relation to its preferred embodiments, it is to be understood that this disclosure is only illustrative and exemplary of the embodiments of the present invention and is made for purposes of providing a full and enabling disclosure of the invention.

The foregoing disclosure is not intended for, and is not to be construed to limit the present invention or otherwise to exclude any such other embodiments, adaptations, variations, modifications, and equivalent arrangements, the present invention being limited only by the claims appended hereto and the equivalents thereof.

What is claimed is:

1. An attachment comprising:

cushion means for resting an injured or operated-upon limb;

a platform, said platform having a first portion on which said cushion means is mounted and a second portion traversely extending from said first portion, said second portion having a pair of platform slots in parallel, said pair of platform slots running along the length of said second portion to allow said platform to become adjustable horizontally relative to said bracket means within a second range defined by the platform slots;

holding rod means; and bracket means for detachably securing the second portion to said holding rod means, said bracket means having a pair of bracket slots in parallel, said pair of bracket slots running along the length of said bracket means to allow said platform to become adjustable vertically relative to said bracket means within a first range defined by the bracket slots.

2. An attachment as recited in claim 1 wherein said pair of platform slots are coupled to said pair of bracket slots with connecting means at a right angle so that said platform can be adjusted horizontally or vertically and so that a 90° adjustable angle of said platform relative to said bracket means can be provided.

3. An attachment as recited in claim 1 wherein said platform is essentially in a L shape.

4. An attachment for a walking assistive device having a single vertical shaft comprising:

a platform, said platform having a first portion and a second portion, said second portion traversely extending from said first portion, said second portion having a pair of platform slots in parallel that run along the length of said second portion to allow said platform to become adjustable within a first range defined by the platform slots;

a cushion mounted on the first portion for resting an injured or operated-upon limb; and bracket means for coupling said platform to said single vertical shaft, said bracket means having a pair of bracket slots in parallel that run along the length of said bracket means, said bracket means being detachably secured to the second portion with the pair of bracket slots being coupled to said pair of bracket slots at a right angle so as to clamp said platform to said single vertical shaft and to allow said platform to become adjustable within a second range defined by the bracket slots so that said platform can be adjusted in both vertical and horizontal directions.

5. An attachment as recited in claim 4 wherein said bracket means is angularly adjustable relative to said second portion.

6. An attachment as recited in claim 5 wherein the adjustable angle is 90°.

7. An attachment as recited in claim 6 wherein said platform is essentially in a L shape.

* * * * *